United States Patent [19]

Nakai

[11] Patent Number: 4,625,152

[45] Date of Patent: Nov. 25, 1986

[54] TRICOLOR FLUORESCENT LAMP

[75] Inventor: Katsumasa Nakai, Amagasaki, Japan

[73] Assignee: Matsushita Electric Works, Ltd., Osaka, Japan

[21] Appl. No.: 628,738

[22] Filed: Jul. 9, 1984

[30] Foreign Application Priority Data

Jul. 18, 1983 [JP] Japan ..... 58-131593

[51] Int. Cl.[4] ..... H05B 37/00

[52] U.S. Cl. ..... 315/317; 315/211; 315/217; 315/324; 315/DIG. 1

[58] Field of Search ..... 315/DIG. 1, 317, 323, 315/324, 211, 217; 313/610, 25, 634, 493

[56] References Cited

U.S. PATENT DOCUMENTS

| | | | |
|---|---|---|---|
| 1,932,509 | 10/1933 | Cadieux | 313/112 |
| 3,609,436 | 9/1971 | Campbell | 313/493 |
| 4,199,708 | 4/1980 | Lauwerijesser | 313/493 |

*Primary Examiner*—Harold Dixon

*Attorney, Agent, or Firm*—Koda and Androlia

[57] ABSTRACT

A tricolor fluorescent lamp operating on a DC power source is disclosed herein. The lamp comprises an outer envelop defining therein a sealed space in which an ionizable medium is filled at low pressure. Disposed within said outer envelop are three tubular envelops of a generally inverted U-shaped configuration which define correspondingly three separate discharge paths and which are coated with respective fluorescent substances emitting different colors. Three sequentially energized anodes are located within the sealed ends of the respective envelops and a common cathode is disposed in adjacently facing relation with the open ends of the envelops, such that the three envelops can be sequentially energized to emit the specific colors which are additively mixed in various proportions to produce a desired color as emitting from the whole lamp. Said U-shaped configuration of the tubular envelops emitting different colors results in the elongated discharge paths or increased light emitting surfaces within a limited space, providing a compact arrangement of the tricolor lamp to be well suitable for decorative illumination. Also, the bent portions of the U-shaped envelops are cooperative to provide a viewing surface on which all three color emitting sources can appear, which renders the tricolor lamp to be well adaptable for use as a picture element in a color display. Further, the sequential shifting of the discharge paths allows the common cathode to be constantly energized, preventing irregular color reproduction which would otherwise result from the interruption in energizing the cathode during the course of changing the colors to be emitted from the lamp.

4 Claims, 20 Drawing Figures

TRICOLOR FLUORESCENT LAMP

BACKGROUND OF THE INVENTION

1. Field of the Invention

The present invention is directed to a tricolor fluorescent lamp, and more particularly to a tricolor fluorescent lamp adaptable both for decorative illumination as well as for a picture element in a color picture display.

2. Description of the Prior Art

There has been proposed a tricolor fluorescent lamp for decorative illumination which comprises a single tubular envelop having electrodes at both longitudinal sealed end and having therein partitions which divide the inside space or discharge space into three circumferentially spaced sections, these sections being coated with respective fluorescent substances that emit different colors, for example, red, green and blue. An external magnet is cooperative with the lamp to deflect the discharge path between the electrodes into any one or two of the three sections so as to emit the corresponding primary color or colors in predominant proportions, making possible to produce any other color by adjusting the amount of deflection. Thus, the above lamp as a whole can present any desired colors which is most advantageous for decorative illumination, but it is not allowed by the above construction to provide a viewing surface on which all the three color emitting sections appears, which renders such lamp unapplicable to the use as a picture element for a color display.

While on the other hand, it is known that fluorescent lamps of special configuration may be utilized to form the picture element for the color display, particularly for a large scale one, in lieu of conventional colored incandescent lamps or cathode ray tubes, because of the fact that they require less amount of power consumption than the colored incandescent lamps as well as that they provides higher luminance brightness than the cathode ray tubes. There have been proposed a wide variety of fluorescent lamps of such special configuration as to be applicable to the color display. FIG. 1 shows, for example, one typical lamp 1 which comprises a phosphor-coated tubular envelop of convoluted tridimensional configuration that contains a pair of electrodes and an ionizable medium. For construction of the color display a multiplicity of the above fluorescent lamps are to be arranged in matrix so as to form each one picture element 2 by the combination of three lamps 1R, 1G and 1B having the envelops coated with respective phosphers emitting different colors, i.e., red, green and blue, as illustrated in FIG. 2. In this construction, however, the lamps 1R, 1G and 1B are required to be driven separately with each other, or by a corresponding number of the discharging circuits and therefore each one of the picture elements 2 requires three separate discharging circuits. Accordingly, the utilization of such fluorescent lamps for the color display renders the driving or discharging circuit complex and requires a large number of components which render the whole device unacceptably bulky. Further, in the above arrangement, each of three separately driven lamps is subject to continuous on and off operations for causing the one picture element to present a desired color reproduction and is therefore subject to repeated heating and cooling operations so as to be exposed to the fluctuation in the surrounding temperature. In view of that the hue and luminance brightness of such lamp depend largely upon the surrounding temperature, such fluctuation will be the serious cause for irregular color reproduction and is therefore should be avoided for clear color reproduction in the color display. In addition, each of said lamps subject to the above on and off operations will inevitably require during the course of varying the color to be emitted from the one picture element a certain starting time, although it is much shorter than that required with the incandescent lamp but is still longer than that with the cathode ray tube, thus preventing the color display system from having a higher response characteristics as near as the cathode ray tubes.

SUMMARY OF THE INVENTION

The above drawbacks have been eliminated by the present invention which provides a unique tricolor fluorescent lamp suitable both for decorative illumination and for forming a picture element in a color display. The tricolor fluorescent lamp in accordance with the present invention is characterized to provide a compact arrangement of light sources emitting different colors in which the light emitting surface is increased within a limited space, thus being advantageous for decorative illumination purposes. And it is further characterized to provide a viewing surface on which three light sources of different colors appear, which is essential for forming a picture element in the color display. The tricolor fluorescent lamp includes an outer envelop sealed by a stem to define therein a sealed space in which an ionizable medium including an inert gas and mercury vapor is filled at low pressure and three tubular envelops of a generally inverted U-shaped configuration disposed within said sealed space so as to define thereby three separate discharge paths within said sealed space. The substantially entire inner surfaces of the tubular envelops are coated with fluorescent substances emitting lights of different colors upon receiving the ultraviolet radiation. The U-shaped configuration of each tubular envelop coated with with the fluorescent substance is responsible for increasing a light emitting surface within a limited space or within the outer envelop, giving the compact arrangement of the light sources so that the lamp is suitable for said decorative illumination purposes. Also, the top portions or the bent portions of the individual U-shaped tubular envelops are cooperative to define a viewing surface on which three light sources emitting different colors appear so as to be well adaptable for use as a single picture element. Three anodes provided on the stem are positioned within the sealed ends of the respective tubular envelops and are cooperative with a common cathode disposed on the stem in spaced relationship with the open ends of the respective tubular envelops so as to complete the individual discharge paths, whereby when the anode are energized in a sequentially controlled manner the colors emitted from the three tubular envelops can be additively mixed in various proportions to produce a desired color.

Accordingly, it is a primary object of the present invention to provide a tricolor fluorescent lamp which is well adapted for decorative illumination when used alone as well as for use as one picture element for the color display.

Said lamp is connected through at least one ballast resistor to a DC power source to be operated thereon. Connected in series with the ballast resistor and connected between the anodes and the positive side of the power source is switching means which energizes sequentially the three anodes in such a way as to activate sequentially the discharge paths defined respectively by said tubular envelops for emitting different colors in a sequential manner which are additively mixed, whereby to produce any desired color as emitting from the whole lamp by shifting the above discharge paths in such a shorter period that the human eye can no more follow the shifting of said discharge paths, that is, in a shorter period of about 10 msec or less. Said ballast resistor connected in series with the switching means is preferably variable so that the luminance brightness for the tubular envelops can be adjusted to provide an optimum illumination level. With this arrangement that the respective tubular envelops emitting different colors have the common cathode, the cathode will not suffer interruption of power or be kept heated during the lighting operation of the lamp so that there is no substantial variation in the surrounding temperature within the outer envelop to have all the tubular envelops heated to substantially the same temperature, preventing the occurrence of irregular color emitted from any one of the tubular envelops to be subsequently energized, such irregular color would be otherwise seen in the case where the tubular envelops have the respective pairs of electrodes to be subject to the frequent interruption of power and therefore subject to the repetition of heating and cooling during the color changing operations. Further, the constant energization of the common cathode can allow the tubular envelops having the respective anodes to rapidly establish the discharges in succession without requiring a starting or warm-up time, thus increasing a response time to a control signal for rapidly presenting a desired color reproduction. These features are particularly required and most advantageous when the above lamp is employed as the picture element in the color display.

It is therefore another primary object of the present invention to provide a tricolor fluorescent lamp which is capable of providing optimum color representations without producing irregular color as well as of being operated at a rapid response rate.

In the preferred embodiment of the present invention, the outer envelop is shaped in the form of a triangular prism having a closed top and an open bottom both of an equilateral triangle. The open bottom of the outer envelop is closed or sealed by the correspondingly shaped equilateral triangular stem having at its center of triangle said common cathode and having at its apexes of triangle the respective anodes. Said three tubular envelops of an inverted U-shaped configuration are disposed within the outer envelop in such an arrangement that the open ends of the tubular envelops are directed to the center of the triangular stem while the opposite ends thereof are sealed to the apexes of the stem, whereby allowing the tubular envelops emitting different colors to have the discharge paths of the same length. This enables the discharging operation for the three envelops to be easily controlled without requiring any compensation. Also with this triangular arrangement of the tubular envelops, a multiplicity of the tricolor lamps of the present invention can be readily arranged in matrix for construction of the color display.

It is therefore a further object of the present invention to provide a tricolor fluorescent lamp which is capable of being easily controlled and readily incorporated in the color display.

Once the tricolor lamp having three sequentially energized discharge paths is turn to present a black color, or all the electrodes are deenergized to cease the discharge in any of the discharge paths, there will be required more time for restarting the discharge to present a next color representation other than black, which will cause a undesired delay in the shifting of the color reproduction. This problem is overcome by the present invention which includes preheating means for preheating said common cathode only when all the anodes are deenergized. Therefore, the shifting of the color reproduction from black to any other color can be performed without the delay for providing smooth color shifting as in the shifting from any other color, which is therefore a still further object of the present invention.

These and still other objects of the present invention will be more apparent in the following detailed description of the preferred embodiments when taken in conjunction with the attached drawings.

DETAILED DESCRIPTION OF THE EMBODIMENTS

Figure 1:
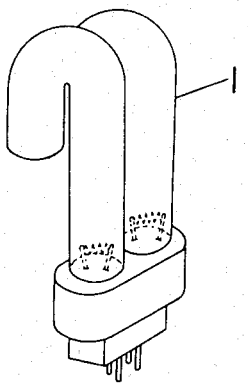
Fig. 1 (PRIOR ART)
FIG. 1 is a perspective view of a prior fluorescent lamp adaptable to form a picture element in a color display.
Figure 2:
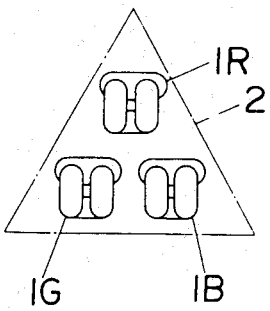
Fig. 2 (PRIOR ART)
FIG. 2 is a schematic representation of one picture element formed by the combination of three pieced of the above prior fluorescent lamp.
Figure 3:
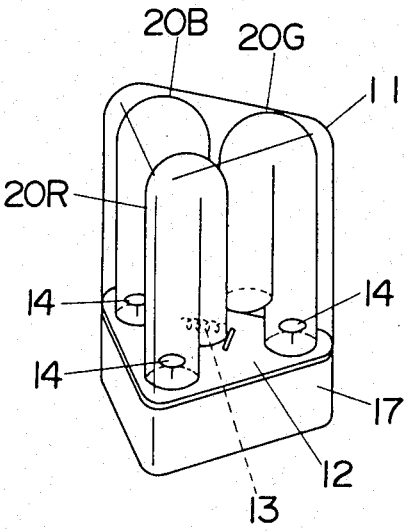
FIG. 3 is a perspective view of a tricolor fluorescent lamp in accordance with a first preferred embodiment of the present invention.
Figure 4:
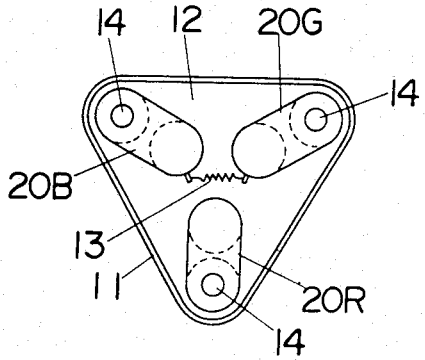
FIG. 4 is a top view of the above tricolor lamp.
Figure 5:
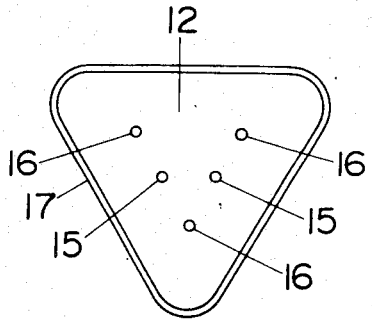
FIG. 5 is a bottom view of the above tricolor lamp.

Referring now to FIGS. 3 to 5, there is shown a tricolor fluorescent lamp designed to be operated on a DC power source through a suitable ballast resistor in accordance with a first preferred embodiment of the present invention. The tricolor lamp comprises an outer envelop 11 made of translucent and vitreous material to be in the shape of a triangular prism having a closed top and an open bottom both of an equilateral triangle. A stem 12 is secured hermetically to the bottom of the outer envelop 11 to define therebetween a sealed space in which an ionizable medium including an inert gas and mercury vapor is filled at low pressure. Mounted on the stem 12 are a common cathode 13 in the form of a filament and three pieces of anodes 14 in the form of a plate, the cathode 13 being located at the center of the triangle and the anodes 14 being located respective apexes thereof. Terminal pins 15 for the cathode 13 and terminal pins 16 for the individual anodes 14 project downwardly through the stem 12 for connection with the DC power source, these pins projecting within the depth of a skirt 17 secured to the lower end of the outer envelop to extend downwardly therefrom. Disposed within said sealed space between the outer envelop 11 and the stem 12 are three congruent pieces of tubular envelops 20R, 20G and 20B which are made of the same material as the outer envelop 11 and shaped into a generally inverted U-shaped configuration with parallel legs connected by a bent portion at the upper ends, one leg being slightly shorter than the other. These tubular envelops 20R, 20G and 20B are supported on the stem 12 with the lower ends of the longer legs hermetically sealed thereto at the apexes of the triangle thereof in such a way that the above anodes 14 are confined within those ends. The lower ends of the shorter legs terminate in a plane spaced upwardly from the stem 12 and located at the portions equally displaced from the center of the stem 12 so as to be open in the immediate vicinity of said common cathode 13, as best shown in FIGS. 3 and 4. Accordingly, three separated discharge paths having the same length are defined by the above three tubular envelops 20R, 20G and 20B. The entire inner surfaces of the tubular envelops 20R, 20G and 20B are coated with fluorescent substances of emitting three primary colors, that is, red, green and blue upon the occurrence of electric discharge within the tubular envelops 20R, 20G and 20B between the common cathode 13 and the respective anodes 14.

Figure 6:
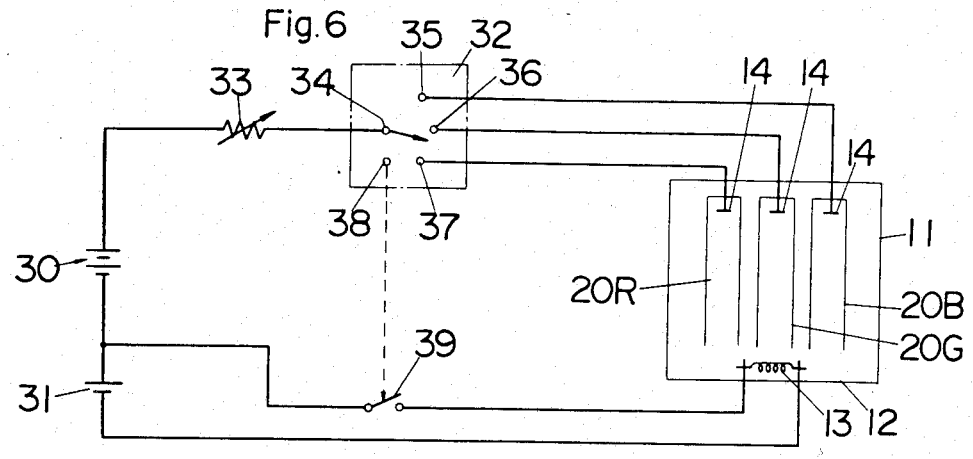
FIG. 6 is a schematic circuit diagram adaptable for operating the above tricolor lamp.

The anodes 14 are energized in a sequentially manner by a suitable switching means within a shorter time period of about 10 msec or less such that the primary colors emitted from the respective ones of the three tubular envelops 20R, 20G and 20B are additively mixed to produce any other colors. Thus, the above tricolor fluorescent lamp can produce any desired color or hue by suitably energizing the anodes 14 sequentially in such a manner as to vary within a unit time period of about 10 msec or less the ratio of the total time intervals during which one tubular envelop is energized to emit the specific color to those for the other tubular envelops. FIG. 6 shows a schematic circuit diagram for operating the above lamp on the DC power source 30 including an auxiliary DC source 31 for preheating the common cathode 13, in which the switching means 32 is illustrated only in functional representation. The switching means 32 is preferably of electronic type and constitutes together with a variable ballast resistor 33 a control section, said ballast resistor 33 serving additionaly to adjust simultaneously the luminance brightness of the specific colors emitted from the respective tubular envelops 20R, 20G and 20B. Said switching means 32 comprises a common terminal 34 connected to the positive side of the DC power source 30 and three anode terminals 35, 36 and 37 connected respectively to the anodes 14 plus an auxiliary terminal 38. The cathode 13 is connected across said auxiliary DC source 31 through a switch 39 which is operatively connected to said auxiliary terminal 38 so that it is closed only when the common terminal 34 is in connection with the auxiliary terminal 38, that is, when neither of the anodes 14 is connected to the DC source 30 at which time no discharge occur in any of the tubular envelops 20R, 20G and 20B to produce no fluorescent radiation or present black color.

Figure 7:
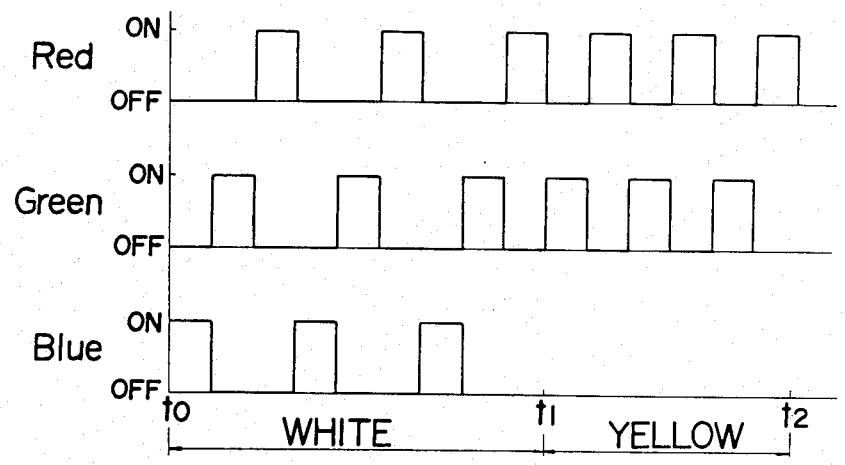
FIG. 7 is a waveform chart showing one example of the operating sequence of individual tubular envelops in the above tricolor lamp for producing white color followed by yellow color.
Figure 8:
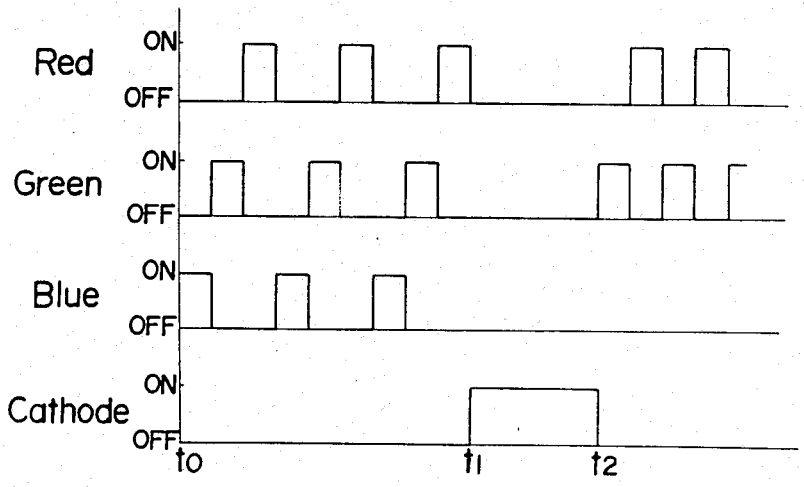
FIG. 8 is a waveform chart showing another example of the operating sequence of the above lamp for producing firstly white and then black followed by another color.

The connection of the common terminal 34 with one of the anode terminal and the auxiliary terminal is controlled in the sequential manner as aforesaid for producing a desired color by additively admixing the primary colors specific to the respective tubular envelops 20R, 20G and 20B. FIG. 7 shows, for example, the operating sequence of producing white color for a first time period $t_0$ to $t_1$ in which all the three tubular envelops 20R, 20G and 20B are energized repeatedly so as to emit for the same minute time intervals red, green and blue colors to be additively mixed, and then producing yellow color for the successive time period $t_1$ to $t_2$ in which two of the envelops 20R and 20G are repeatedly energized to emit red and green to be additively mixed. FIG. 8 shows another operating sequence of producing successively white color and yellow color interrupted by black color, that is, three tubular envelops 20R, 20G and 20B are energized repeatedly to produce white color as a whole by additively admixing the primary colors emitted respectively therefrom during the time period $t_0$ to $t_1$, then all the envelops are deenergized to represent black color during the time period $t_1$ to $t_2$, and thereafter two of the envelops 20R and 20G are energized repeatedly to produce yellow color by additively mixing red and green emitted therefrom. In the above time period $t_1$ to $t_2$ where all the tubular envelops are deenergized, the above switch 39 is kept closed to energize or heat the cathode 13, whereby the cathode 13 is immediate ready for the next discharge of any of the three envelops 20R, 20G and 20B so that the succeeding color reproduction can be immediately performed without requiring a warm-up time or without a delay for effecting smooth color change. In addition to the above, the voltage applied to the cathode 13 during the time period of deenergizing all of the three tubular envelops 20R, 20G and 20B will alleviate the voltage impact upon the cathode 13 at the succeeding time of restarting the discharge between the cathode 13 and the anodes 14, extending the operating life of the cathode 13 or the lamp. Further, since the above switch 39 is arranged to be only closed when all of the three envelops 20R, 20G and 20B are deenergized and to be open when either of the three envelops is energized, there is no additional power consumption for the cathode 13 during the lighting operation of the envelops.

Figure 9:
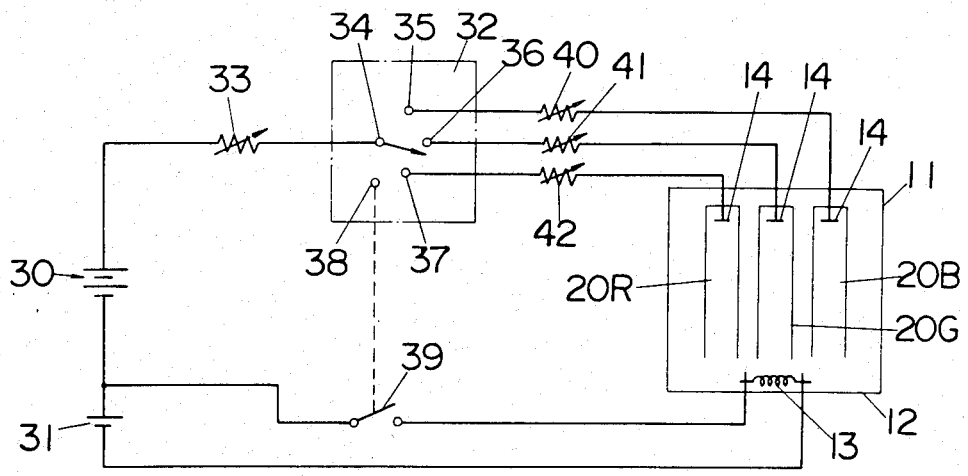
FIG. 9 is another schematic circuit diagram adaptable for operating the above tricolor lamp.

FIG. 9 shows a modification of the above operating circuit which is similar to the above circuit of FIG. 6 except that three variable resistors resistors 40, 41 and 42 are inserted respectively between anode terminals 35, 36, 37 and the corresponding anodes 14 for the purpose of providing seperate adjustment of luminance brightness with respect to the individual tubular envelops 20R, 20G and 20B, with the result of this an optimum color representation can be obtained.

Figure 10:
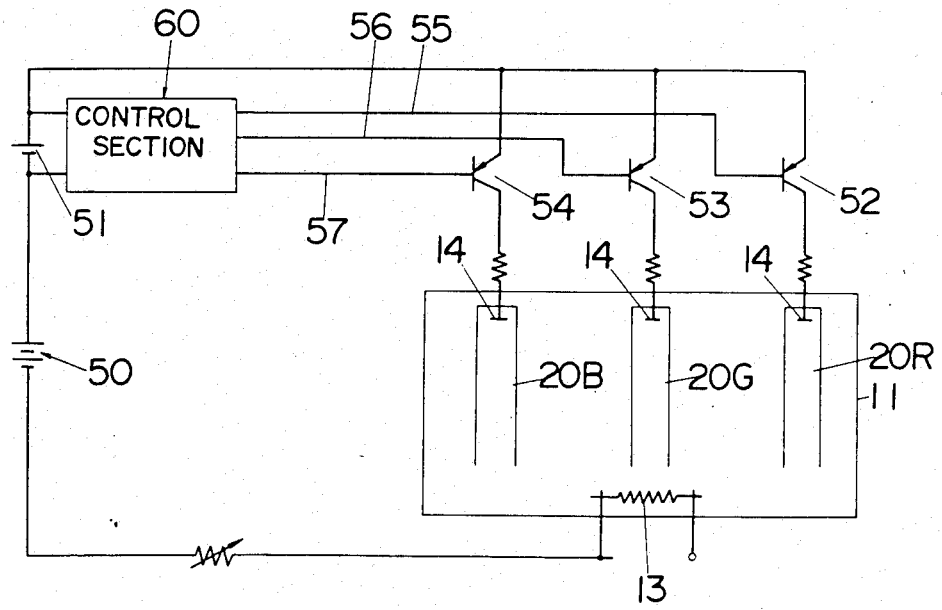
FIG. 10 is a further circuit diagram in schematic representation adaptable for operating the above tricolor lamp.
Figure 11:
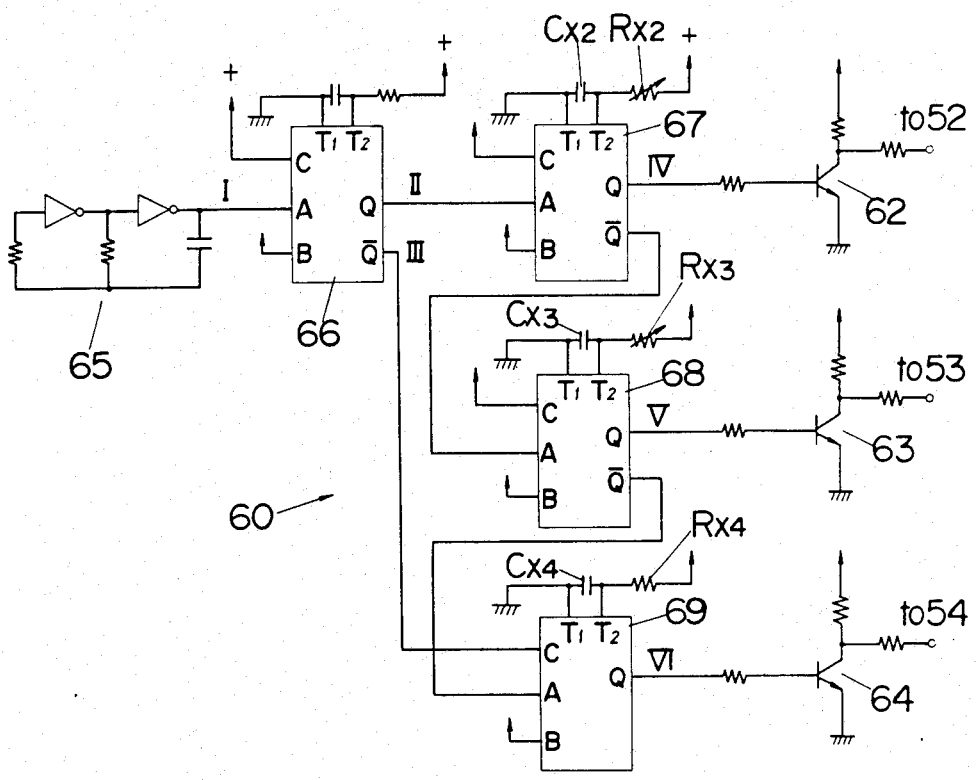
FIG. 11 is a circuit diagram showing a control circuit employed in the circuit of FIG. 10.

Referring to FIGS. 10 and 11, there is shown a further operating circuit for sequentially energizing said three tubular envelops 20R, 20G and 20B on a DC power source 50 including an auxiliary DC source 51 connected serially thereto. Three parallel switching transistors 52, 53 and 54 are connected between the positive side of the DC power source 50 and the respective anodes 14 of the tubular envelops 20R, 20G and 20B, the collectors of the transistors being connected through suitable resistors to the corresponding anodes 14. Said switching transistors 52, 53 and 54 have their bases connected through lines 55, 56 and 57 to a control section 60 to be driven thereby in a sequential manner. The control section 60 is connected across said auxiliary DC source 51 to derive the power therefrom and includes three driving transistors 62, 63 and 64 for driving said switching transistors 52, 53 and 54 through the respective lines, as shown in FIG. 11. Further included in the control section 60 are an astable multivibrator or clock 65 providing a timing train of pulses at a cycle of about 10 msec or less, of which waveform is indicated by I of FIG. 12, and the combination of a first, second, third and fourth monostable or one-shot multivibrators 66, 67, 68 and 69, all of which are the C/MOS 4528 and coupled to timing components.

Figure 12:
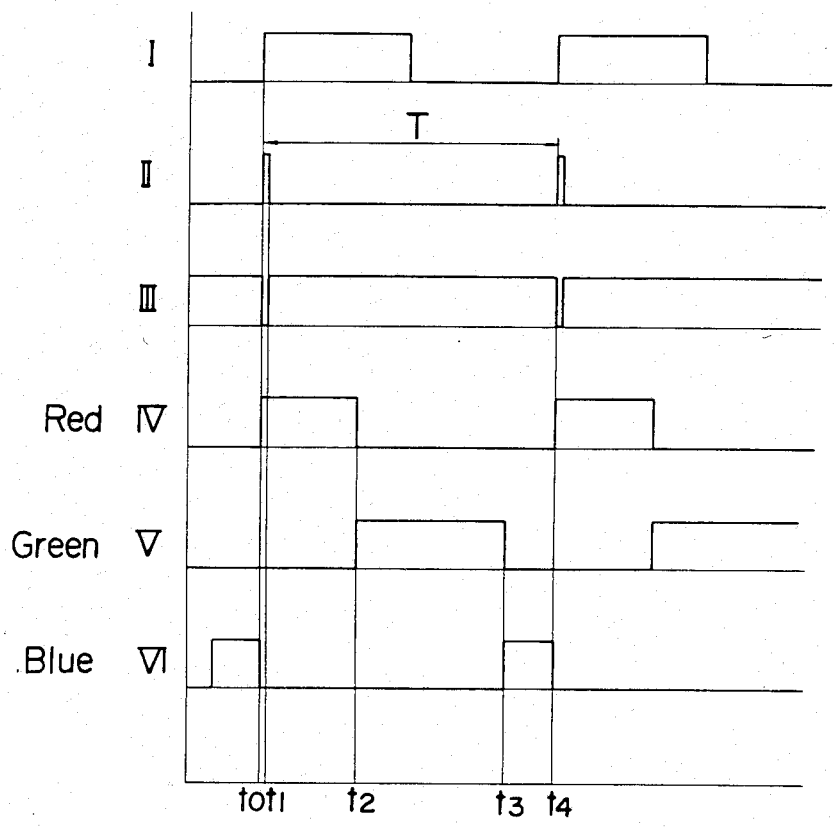
FIG. 12 is a waveform chart showing one example of the operating sequence of the above lamp by the control circuit of FIG. 11.

The operation of the above control section 60 will now be explained with reference to FIG. 12. The first monostable multivibrator 66 triggers on the leading edge of each trigger pulse indicated by I fed from said astable multivibrator 65 so as to provide the Q output indicated by II as well as the $\overline{Q}$ output indicated by III for a limited time interval much less than the width of the pulse I from the astable multivibrator 65. The Q output II of the first multivibrator 66 is then fed to the second monostable multivibrator 67 so as to trigger the same in a leading edge triggered manner for providing the Q output indicated by IV for a time interval $t_0$ to $t_2$. The Q output IV from the second multivibrator 62 is fed to said driving transistor 62 to turn on the same, whereby turning on the corresponding switching transistor 52 for energizing the envelop 20R to emit red color for that limited time interval $t_0$ to $t_2$. Such time interval is determined by the timing components of a capacitor $Cx_2$ of fixed value and a variable resistor $Rx_2$ connected to the second multivibrator 67, so that the adjustment of the variable resistor $Rx_2$ alone can set a desired time interval during which red color is produced. The $\overline{Q}$ output of the second multivibrator 67 is fed to the third multivibrator 68 so as to trigger the same for providing the Q output indicated by V for a limited time interval $t_2$ to $t_3$ which is likewise determined by the timing components consisting of a fixed capacitor $Cx_3$ and a variable resistor $Rx_3$ to be adjustable within the one cycle T of said pulse from the astable multivibrator 65 by the adjustment of the timing resistor $Rx_3$. The Q output V of the third multivibrator 68 is then fed to the driving transistor 63 to turn on the same, whereby turning on the corresponding switching transistor 63 for energizing the envelop 20G to emit green color for that time interval $t_2$ to $t_3$. Both of the $\overline{Q}$ outputs of the first and third multivibrators 66 and 68 are fed to the fourth multivibrator 69 such that the fourth multivibrator 69 provides the Q output VI which goes high on the leading edge of the $\overline{Q}$ output of the third multivibrator 68, or the trailing edge of the Q output V of the same and goes low on the trailing edge of the $\overline{Q}$ output III of the first multivibrator 66. Thus, the Q output VI of the fourth multivibrator 69 lasts for a time interval $t_3$ to $t_4$, which is dependent upon the timing of the Q output V of the third multivibrator 68 going low and the length of one cycle T of the pulse from the astable multivibrator 65, but is determined by the cooperative timing components $Cx_4$ and $Rx_4$ to have a maximum time interval not exceeding the latter. The Q output VI of the fourth multivibrator 69 serves in the same manner as above to energize the corresponding envelop 20B so as to emit blue color by turning on the driving and switching transistors 64 and 54 for that time interval $t_3$ to $t_4$. With this arrangement, the ratio within the one cycle T of the time interval during which one of the three envelops 20R, 20G and 20B is energized for emitting the specific color to those for the other envelops can be varied only by adjusting the timing resistors $Rx_2$ and $Rx_3$, thus enabling the whole lamp to produce any desired color by suitably choosing the above ratio. The adjustment of said variable timing resistors $Rx_2$ and $Rx_3$ is controlled externally by a suitable color determination circuit (not shown).

Figure 13:
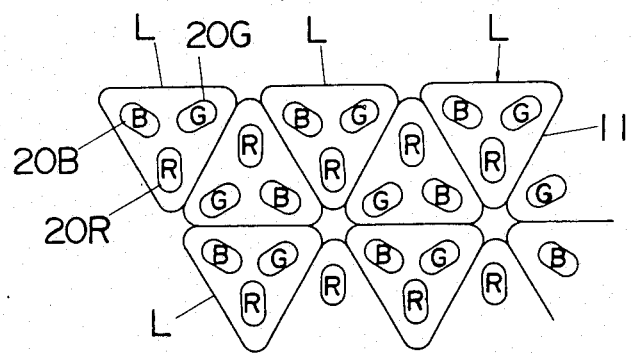
FIG. 13 is a schematic diagram showing a portion of a color picture display in which a multiplicity of the above tricolor lamps are arranged in matrix.

Said tricolor fluorescent lamp producing any desired color by sequentially energizing the three tubular envelops 20R, 20G and 20B respectively for emitting the primary colors is shaped in the present invention to have three U-shaped tubular envelops 20R, 20G and 20B within the outer envelop 11. Accordingly, the discharge paths for the respective envelops can be elongated to have increased light emitting surfaces within a limited space of the outer envelop 11 so as to provide a compact arrangement of the lamp while retaining sufficient amount of light to be emitted, which is most desirable for decorative illumination. Further, the bent portions at the upper ends of the envelops 20R, 20G and 20B are cooperative to define a viewing surface on which the respective color emitting sources can appear separately, thus making the lamp readily adaptable for use as a picture element in a color display in addition to that the envelops 20R, 20G and 20B can be easily energized in a sequential manner. It should be particularly noted at this time that the triangular prism configuration of the outer envelop 11 can effectuate a compact arrangement of a multiplicity of the lamps L for forming the color display, as shown in FIG. 13, in which one lamp L has its lateral sides in close abutting engagement with those of the adjacent three lamps L. Also with the arrangement of the three envelops 20R, 20G and 20B being located at the apexes of the equilateral triangle, one single lamp can successfully constitute a single picture element which is controlled independently of the other picture elements in the color display.

Figure 14:
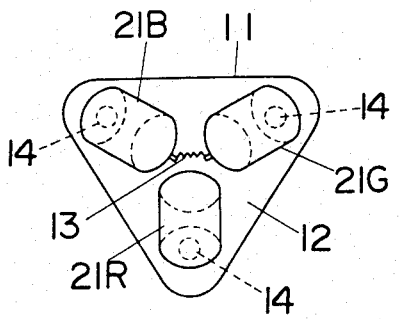
FIG. 14 is a top view of a modification of the above tricolor lamp.

A modification of the above tricolor fluorescent lamp is shown in FIG. 14 in which each of three tubular envelops 21R, 21G and 21B has a cross section of an ellipse and is arranged in such a way as to provide a horizontal projection of a configuration closer to a round shape. This increases the light emitting areas for the respective tubular envelops 21R, 21G and 21B within the horizontal plane or within the viewing surface, thus resulting in more compact arra0gement of the lamp suitable for forming the color display and as well resulting in higher resolution when used as forming the color display. The other construction features are similar to the above embodiment and therefore the same numerals are employed for the same parts.

Figure 15:
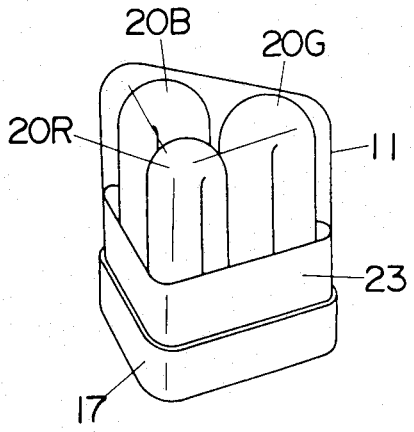
FIG. 15 is a perspective view of another modification of the above embodiment.

FIG. 15 shows another modification of the above embodiment in which the outer envelop 11 is coated at its lower portion with a reflector film 23 which is metallized on the inner surface thereof for reflecting back the light emitted from each of the tubular envelops 20R, 20G and 20B. The lights thus reflected on the film 23 will further reflected and diffused a number of times on the inner surface of the outer envelop 11 and on the outer surfaces of the envelops, so that the addition of the colors emitted from the envelops is improved. Accordingly, the lamp as a whole can produce a desired color of well additively mixed and therefore of clear hue.

Figure 16:
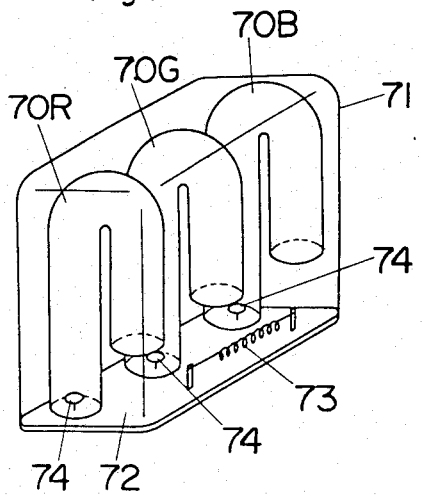
FIGS. 16 and 17 are respectively perspective views of a tricolor fluorescent lamp in accordance with a second embodiment of the present invention.
Figure 17:
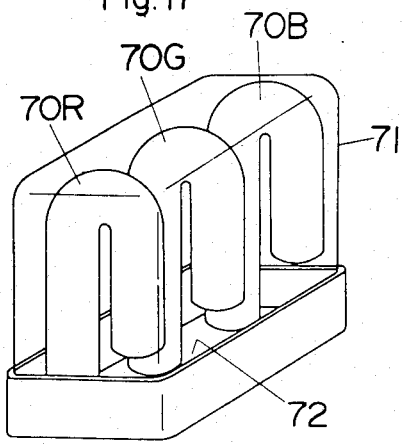
Figure 18:
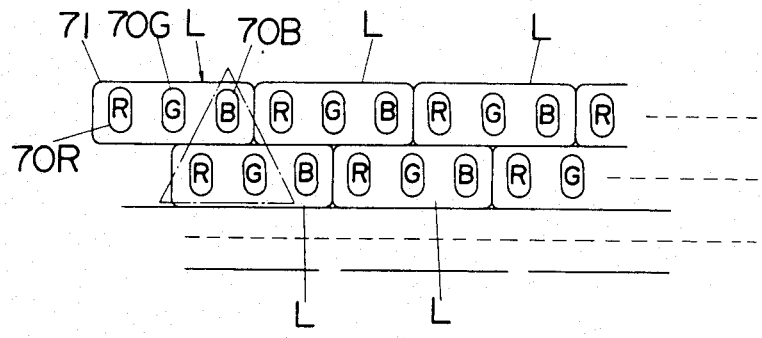
FIG. 18 is a schematic diagram showing a portion of a color picture display in which a multiplicity of the above tricolor lamps are arranged in matrix.

Referring to FIGS. 16 and 17, there is shown a tricolor fluorescent in accordance with a second embodiment of the present invention which is similar to the above first embodiment except that an outer envelop 71 is shaped into a rectangular parallelepiped and that three pieces of tubular envelops 70R, 70G and 70B arranged in a row within the outer envelop 71, the bottom of which is hermetically sealed by a correspondingly shaped rectangular stem 72. In this embodiment, the tubular envelops 70R, 70G and 70B of the same U-shaped configuration as the above embodiment are equally spaced with each other in parallel relationship. The respective one ends of the tubular envelops 70R, 70G and 70B are hermetically sealed to the stem 72 at the portions along one elongated side thereof in such a way as to enclose corresponding anodes 74 of sequentially energized, while the respective other ends are open near a common cathode 73 located at the center of the opposite elongated side of the stem 72. FIG. 18 shows one application of the tricolor lamp thus constructed in which a multiplicity of the lamps L are closed together for forming the color display. In this application, the lamps L are arranged in rows transversely of the display with the lamps of a row staggered with respect to those in adjacent rows, such that two adjacent tubular envelops in one lamp L are cooperative with the one tubular envelop in the immediate upper lamp in the adjacent row to form one trigonal picture element, as enclosed by dotted lines in the figure, consisting of the three envelops emitting the three primary colors, or red, green and blue. Therefore, three adjacent lamps L are combined to present the three picture elements although one lamp does not form a single picture element, enabling one lamp to substantially constitute a single picture element.

Figure 19:
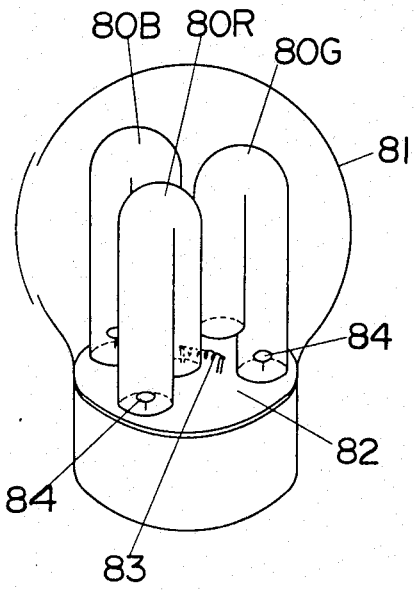
FIG. 19 is a perspective view of a tricolor fluorescent lamp in accordance with a third embodiment of the present invention.

A third embodiment of the present invention is shown in FIG. 19, in which three tubular envelops 80R, 80G and 80B of the same configuration as the above embodiments are disposed within a sealed space defined between a globular outer envelop 81 and a stem 82 of a circular plate. The stem 82 is provided at its center with a common cathode 83 and at its periphery with three anodes 84 which are equally spaced circumferentially, so that the tubular envelops 80R, 80G and 80B have their respective one ends hermetically sealed to the peripheral portion of the stem 83 and have their respective open ends open centrally of the stem 83 about the center axis of the outer envelop 81.

Figure 20:
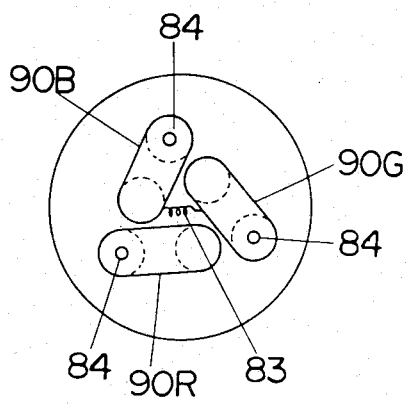
FIG. 20 is a top view of a modification of the above embodiment of FIG. 19.

FIG. 20 shows a modification of the above embodiment of FIG. 19 which is similar to the embodiment except that three tubular envelops 90R, 90G and 90B of the same configuration as above are arranged such that the open end of one tubular envelop is in closer relation with the sealed end of the adjacent tubular envelop, giving rise to a compact or dense arrangement of the three tubular envelops 90R, 90G and 90B.

Although the present invention has been described in its preferred embodiments, it should be understood by those skilled in the art that the present invention is not limited to the present embodiments and various changes and modifications may be made without departing the scope of the present invention.

What is claimed is:

1. A tricolor fluorescent lamp operating on a DC power source through at least a ballast resistor which comprises:

an outer envelop having a closed top and an open bottom;

a stem hermetically sealed to the bottom of the outer envelop for defining within the outer envelop a sealed space;

an ionizable medium including an inert gas and mercury vapor filled within said sealed space at low pressure;

three bent tubular envelops of a generally inverted U-shaped configuration disposed within said sealed space with one end of each tubular envelop being hermetically sealed to the stem and with the other end of each tubular envelop being open to define thereby three separate discharge paths within said sealed space, the substantially entire inner surfaces of the tubular envelops being coated with fluorescent substances emitting different colors;

a common cathode disposed on the stem at the position adjacent to the open ends of the tubular envelops;

three anodes disposed on the stem within the confines of the sealed ends of the respective tubular envelops for being sequentially energized such that the colors emitted from the three tubular envelops can be additively mixed in various proportions to produce a desired color; and said tricolor tubular fluorescent lamp is further characterized in that said outer envelop is the form of an equilateral triangle prism with a closed top and an open bottom sealed by the stem of the correspondingly shaped equilateral triangle, said stem being provided at its apexes of the triangle with the respective anodes and provided at its center thereof with said common cathode so that the open ends of said tubular envelops are directed to the center of the stem with the axes of the tubular envelop being in parallel relationship with each other.

2. The tricolor fluorescent lamp as set forth in claim 1, wherein said fluorescent substances with which the tubular envelops are coated are for emitting three primary colors and have the respective maximum emission spectrum of 400–500 nm, 500–600 nm, and 600–700 nm.

3. A fluorescent lamp device operating on a DC power source which produces various colors which comprises:

a lamp having an outer envelop and a stem hermetically sealed together to define therebetween a sealed space;

an ionizable medium including an inert gas and mercury vapor filled within said sealed space at low pressure;

a plurality of bent tubular envelops of a generally inverted U-shaped configuration disposed within said discharge space with one end of each tubular envelop being hermetically sealed to the stem and with the other end of each tubular envelop being open to define thereby a plurality of separate discharge paths within said sealed space, the substantially entire inner surface of the tubular envelops being coated with fluorescent substances emitting different colors;

a common cathode disposed on the stem at the position adjacent to the open ends of the plurality of tubular envelops;

a plurality of anodes disposed on the stem within the confines of the sealed ends of the respective tubular envelops;

at least one ballast resistor inserted in the circuit between the lamp unit and the DC power source;

a switching means connected in series with said resistor and connected between the anodes and a positive side of the DC power source for repeatedly and individually energizing the anodes for predetermined time intervals such that the colors emitted from the plurality of tubular envelops can be additively mixed in various proportions to produce a desired color;

a controller for giving the predetermined time intervals of energization of each electrode of the inner bent tubular envelops to the switching means; and preheating means for preheating the cathode only when all the anodes are deenergized.

4. The fluorescent lamp device as set forth in claim 3, wherein said ballast resistor is of a variable type.

* * * * *